United States Patent [19]

Whitaker

[11] Patent Number: 5,066,163

[45] Date of Patent: Nov. 19, 1991

[54] RESILIENT SIGN AND GUIDEPOST

[76] Inventor: Kerry Whitaker, 2905 Deep Valley, Plano, Tex. 75075

[21] Appl. No.: 632,952

[22] Filed: Dec. 20, 1990

[51] Int. Cl.[5] ..... E04H 17/14; E02D 23/04

[52] U.S. Cl. ..... 404/10; 256/19

[58] Field of Search ..... 404/10; 256/1, 19; 403/273, 2

[56] References Cited

U.S. PATENT DOCUMENTS

| | | | |
|---|---|---|---|
| Re. 32,045 | 12/1985 | Schmanski | 404/10 |
| 1,866,982 | 7/1932 | Michener . | |
| 4,105,350 | 8/1978 | O'Donnell | 404/10 X |
| 4,122,795 | 10/1978 | Döring | 404/10 X |
| 4,232,712 | 11/1980 | Squires | 403/273 X |
| 4,269,534 | 5/1981 | Ryan | 404/10 |
| 4,290,712 | 9/1981 | Hayes | 404/10 |
| 4,297,050 | 10/1981 | Gmelch | 404/10 |
| 4,343,567 | 8/1982 | Sarver et al. | 404/10 |
| 4,486,117 | 12/1984 | Blau | 404/10 |
| 4,522,530 | 6/1985 | Arthur | 404/10 |
| 4,599,012 | 7/1986 | Kugler et al. | 404/10 |
| 4,787,601 | 11/1988 | Ryback | 256/19 |

*Primary Examiner*—Ramon S. Britts
*Assistant Examiner*—Nancy P. Connolly
*Attorney, Agent, or Firm*—Hubbard, Thurman, Tucker & Harris

[57] ABSTRACT

A resilient sign and guidepost is presented which is suitable for use along roadways for marking the roadway or supporting various roadway signs, the resilient post is comprised of an elongated flexible tube body combined at a lower end portion with a driving stake means inclusive of a suitable driving head for insertion into the ground. The driving stake means supports the elongated flexible tubular body as well as an axially aligned reinforcing rod or rods positioned in the hollow tube body and extending from the driving head of the stake means through a substantial portion of the length of the tubular body. In another embodiment, a solid elongated one-piece resilient post terminating at a lower end portion in a driving stake and driving head means is presented wherein both embodiments provide for driving force to be exerted against the driving head means or the stake portion thus allowing a resilient post member.

7 Claims, 1 Drawing Sheet

RESILIENT SIGN AND GUIDEPOST

BACKGROUND OF THE INVENTION

This invention relates to resilient sign and guidepost, the construction and manufacture of such posts, and more particularly to the construction and manufacture of flexible roadway signs or guideposts. In another aspect the invention relates to flexible posts which are self-erecting in the event the post is accidentally hit or bent by a motor vehicle when the post is utilized in any environment wherein motor vehicles are present.

Motor vehicle traffic control, parking control and roadway control require the use of signs and markers as aids in solving the various problems associated with traffic safety. For many years, various attempts have been made to make roadway posts as well as other types of posts, marker devices and post supporting signs from the forgiving material such as flexible plastic materials. Not only should the posts be made of forgiving materials, for example one which yields in some manner when impacted by a motor vehicle in motion as distinguished from a rigid type device such as a steel post, but the forgiving traffic post should also have the ability to right itself due to the elasticity and resilience of the materials of construction along with the design of the post. In addition, these posts should be able to resist shear on impact thus avoidance of injury to people who may be travelling in motor vehicles which impact the posts. The importance of this type of resilient post has become apparent with increase in accidents involving sign posts and traffic lane markers which have been made of rigid materials that upon impact have snapped and penetrated spear-like into vehicles, in many cases causing death and severe injuries.

In more recent times, it has been found that a useful characteristic for such posts and markers is that these posts have the ability to withstand vehicle impact, without requiring subsequent replacement or without breaking or shearing from the base and becoming a free projectile. An attempt has been made to fulfill this need with various configurations of posts. However, the structure design of such posts must involve the consideration of two opposing structural features, i.e. the resilience required during dynamic conditions to permit the posts to non-destructively bend with vehicle impact and the longitudinal rigidity required during static conditions to withstand forces resulting as the post is driven into the ground.

Most commercially acceptable highway sign and marker posts continue to be made of T-shaped rigid steel construction. Such posts are relatively heavy and expensive and in highway usage such posts pose a substantial safety hazard when struck by vehicles. Substantial damage to the vehicle and personal safety of driver and passengers is compromised by the driver which loses control of the vehicle and in many cases the steel posts have punctured the vehicle causing direct injury to the passengers or driver. In the recent past, these posts have been made of low impact resistant plastic materials which have snapped off but are of such light weight that the posts cannot cause the type of damage or injury which has occurred using stronger steel devices. Other forms of utilized materials which will bend over, but which after impact are not reusable have been proposed. Yet another type of device has taken the form of spring supported cushioning pads or bumpers which are shock absorbent to a certain degree but again, are substantially destroyed by impacting vehicles.

In designing roadway marking or sign posts it is highly desirable for the posts to be constructed in a manner which provides for quick and simple installation and resiliency so that the post is able to withstand several impacts from bumpers of high speed vehicles without damaging or destroying the posts and without pulling the posts out of the ground. The ease and speed of installation is particularly important in view of the large number of marking posts used along the highways and expressways and the fact that frequently the installation of marking posts is performed when the installer is exposed to substantial motor vehicle traffic.

The resiliency is necessary in view of frequent high speeds associated with impacting motor vehicles and the stationary posts. In such cases, if the post does not bend it will likely shear off and will require replacement. Mere bendability, however, is not sufficient since each time a post has been bent it would have to straighten before it could again be functional. This could include high maintenance costs if manual straightening or treatment is required. Ideally, a post should have sufficient resiliency that the post will automatically assume its proper upright configuration after experiencing impact forces.

While resiliency is desirable, the resiliency presents a practical problem when installation of the post is considered. In the past when deformable plastics have been used as post material, installation has frequently required a pre-drilled hole or insertion of some support receptacle in the ground. Drilling the hole and/or implanting a receptacle in the ground followed by the subsequent positioning of the plastic post into the hole or receptacle is time consuming and not satisfactory. These multiple step installations have been required because previously known resilient posts have not withstood buckling force applied during attempts to drive the post into hard surfaces. Consequently, the same resilient properties which permit the non-destructive deformation upon impact causing the buckling of a post subjected to the driving force along its axis. The dual requirements of resiliency and rigidity utilizing spring devices and various elastomeric post construction have only been partially successful. While the foregoing problems have been long recognized and the use of plastic materials for posts has previously been suggested, the present invention utilizes the following different concepts to solve these prior problems.

The resilient sign and guidepost according to the invention is not subject to the limitations of these previously known devices but is a resilient device which bends sufficiently over on impact, allowing the vehicle to pass over the post thereafter the post resiliently returns to its normal use position. The post thus achieves the advantage of safety to people combined with an effective low cost because it remains usable and may not need to be immediately replaced with a new unit. Simplistic construction provides additional advantages along with ease of installation and relatively inexpensive manufacturing. In addition, it is desirable for the post to be installed in a manner by which the post may not be easily damaged or removed by a person walking along the roadway. The post should also be amenable to carrying reflective material, signs or other mounted informational features which cannot be easily scraped off or removed from the post by vandal or a motor vehicle impacting the post.

U.S. Pat. No. 3,875,720 discloses an approach to the problem of providing elasticity to a post that can be driven. A post is formed by a bundle of flexible rods that are clamped together to obtain a desired rigid property required doing static installation of the post. Deformation of posts during dynamic conditions is permitted by deflection of the various rods away from the central axis of the post structure. Economic factors appear to have impeded utilization of such structure despite the growing need for such a post.

U.S. Pat. No. 4,522,530 provides a self-erecting roadway marking post through utilization of an extruded resilient plastic material tube with a lower end portion of the tube carrying a set of spring fingers which project outwardly from the tube to engage the ground surrounding a hole which receives the lower end portion of the tube. Another self-erecting roadway marking post is presented by U.S. Pat. No. 4,343,567 wherein a metal anchor tube is driven into the ground which defines a cavity for receiving a lower end portion of an elongated cylindrical flexible marking tube. A resilient plastic reinforcing tube is inserted within a long marking tube so that it bends with the marking tube and aids in returning the marking tube to its normal upright position after being hit. Both of these self-erecting roadway marking posts utilize some sort of separately installed base anchor mechanism and/or spring mechanism to assist the elongated flexible tube or post to be self-erecting.

SUMMARY OF THE INVENTION

According to the invention a resilient sign or guidepost is presented which is suitable for use along roadways for marking or supporting signs. The resilient post can be manufactured from various resilient plastic materials capable of forming elongated flexible tube having an annular hollow cross section configuration. The elongated flexible tube body is combined at a lower end portion with a driving stake means inclusive of a suitable driving head for insertion into the ground along the roadway. The driving stake means supports the elongated flexible tubular body as well as an axially aligned reinforcing rod or rods positioned in the hollow tube body and extending from the driving head of the stake means through a substantial portion of the length of the tubular body of the post. The one piece elongated resilient tube and stake means provides a driving head interior of the tubular body and circumferential around the reinforcing rod. The resilient tubular body has a partially flattened upper end portion suitable for mounting signs or marker devices, the partially flattened portion allowing the open cavity to exist throughout the length of the tube for access to the interior head.

In another embodiment a solid elongated one piece resilient post terminating at a lower end portion in a driving stake and driving head means is presented with at least one reinforcing rod encapsulated within the solid resilient post member. The resilient post member being of sufficient flatness to support a sign or marking device at its upper end portion. The somewhat flat configurated solid reinforced post has a lesser width than the head of the driving stake means thus providing a drive head portion of the stake means which is of greater dimension than the dimensions of the flat resilient post. In this embodiment can have a monolithic structure made from a suitable thermal setting plastic material or the like; however generally the resilient post and driving stake are constructed of different materials. The post and driving stake require different flexibility and rigidity. The post are of solid cross-sectional configuration which may be of a relatively small cross-sectional area but can include cylindrical construction post with flattened portions. Ground penetration stake means inclusive of stabilizer means and driving means can be integrally molded onto solid posts. The posts are resilient under high load while being sufficiently rigid to perform the intended function during normal use; however the post according to the invention do not require a sufficient degree of rigidity to support direct driving forces.

The resilient post of the invention whether of the hollow configuration or the solid configuration constitute a unitized post having a post feature attached to or even molded with a stake means for driving and placing the post into the ground. The stake means has a ground penetrating lower portion and can have intermediate stabilizing fins. The stake means has a driving head portion either adjacent to the solid post or internal of the hollow post.

Other features and advantages of the invention will be apparent from the following description, the accompanying drawings and the appended claims.

DETAILED DESCRIPTION OF THE INVENTION

The resilient sign and guidepost according to the invention provides for an elongated tube or thin solid post of resilient nature in combination with a solid stake means having a driving head capable of allowing forced driving of the single post and stake means directly onto the stake means without deformation of the less rigid post, tube or shaft. Such a configuration allows for light weight and resiliency while providing the means for anchoring the combination resilient post into the ground by manual or machine post driving thereby affording a self-erecting post member yet mounted on a stake member of sufficient strength to be driven into the ground without deformation.

Figure 1:
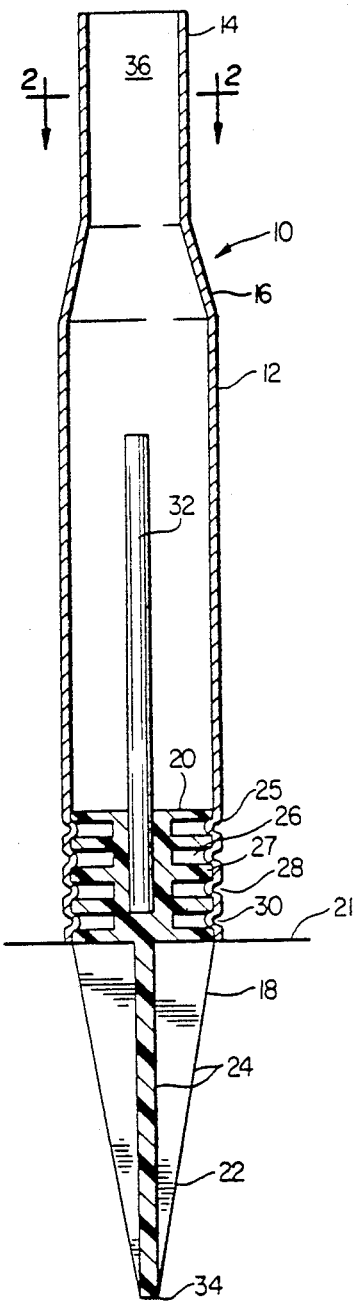
FIG. 1 is a longitudinal, sectional side view of one embodiment of a resilient post having the general features of the present invention positioned with a driving stake means lower portion inserted into the ground and an information or reflector carrying flattened surface upper end portion.

Referring to FIG. 1 the resilient post 10 of an elongated tubular configuration is shown in a longitudinal, sectional side view. The resilient post 10 is comprised of a hollow cylindrical tube 12 with a flattened upper end portion surface 14 which is connected to the hollow cylindrical tube 12 by neck portion 16. The resilient post 10 is affixed to a driving stake means 18 having a driving head 20 which is interior of the hollow cylindrical tube 12 and accessed from the open end or top of the resilient post 10. The driving stake means 18 is shown in a use posture relative to a ground level 21 wherein the driving stake means 18 has been inserted into the ground by being driven through the resilient post hollow tubular interior by contact of a driving apparatus against driving head 20. The driving stake means 18 is comprised of a penetrating tip means 22 with various stabilizing rib members 24 which assist in erecting the post in a proper vertical alignment relative to the ground during forced driving. The driving stake means 18 presents between the driving head 20 and that portion of the driving stake means 18 which is generally inserted into the ground, a stake head 25 having grooves 26 and stake head rib portions 27. During manufacture of the resilient post 10, the resilient post wall material, i.e. tubular wall material 28 is shrink bonded to form a shrink fit 30 to the stake head 25 through utilization of the alternative grooves 26 and stake head rib portions 27.

A flexible reinforcing rod 32 is mounted in the stake head 25 as a base support and extends substantially through the length of the interior tubular portion of the hollow cylindrical tube 12 of the resilient post 10. The flexible reinforcing rod 32 can be comprised of more than one rod configuration however is substantially according to the embodiment shown in FIG. 1 in axial alignment with the driving stake means 18 and the hollow cylindrical tube 12 of the resilient post 10.

Figure 2:
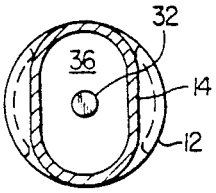
FIG. 2 has a horizontal cross-sectional view through the post when viewed along line 2—2 of FIG. 1.
Figure 3:
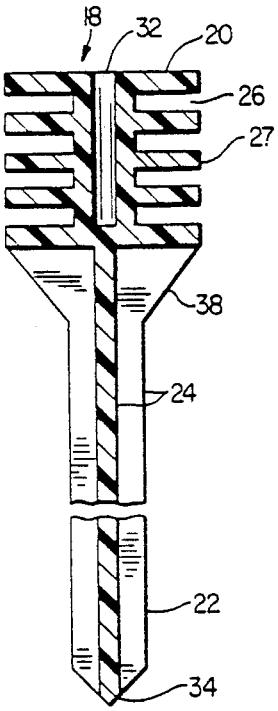
FIG. 3 is an enlarged side elevational view of one embodiment of the driving stake means removed from the resilient post and shown in isolation.
Figure 4:
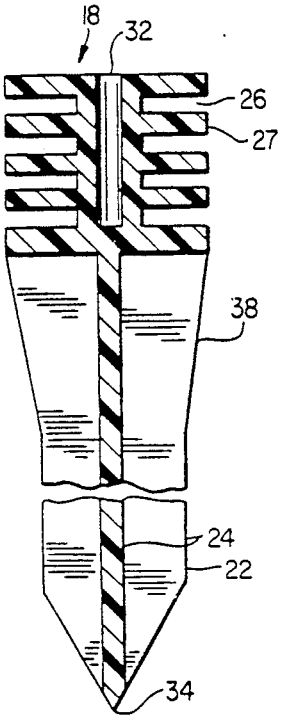
FIG. 4 is another embodiment of the driving stake means removed from the resilient post in an enlarged side elevational view.

The resilient post 10 terminates at one end in a driving point 34 of the driving stake means 18 and an upper end hollow portion 36 which is interior of the flattened upper end portion surface 14. The flattened upper end portion surface 14 generally supports marking or informational sign fixtures, thus the need for a partially flattened surface on the resilient post 10. The horizontal cross-sectional view through the post viewed along lines 2—2 of FIG. 1 provides a different view of the upper end hollow portion 36 relative to the axially aligned flexible reinforcing rod 32. In addition, the flattened upper end portion surface 14 is more clearly indicated in relationship to the hollow cylindrical tube 12 configuration of the resilient post 10. The horizontal cross-sectional view of FIG. 2 does not show any of the details of the driving stake means 18 which are more clearly presented in the elongated side elevational views of FIG. 3 and a large side elevational view of FIG. 4 of two different embodiments of the driving stake means 18 according to the invention. In FIGS. 3 and 4, the flexible reinforcing rod 32 is shown to be mounted as an integral part of the driving stake means 18. The driving head 20 at the top of the stake head 25 is generally dimensionally larger than the stabilizing rib means 24 which are of a reducing dimension as indicated by the rib means neck portion 38. The stake head 25 is inclusive of alternating grooves 26 and stake head rib portions 27 which allow shrink fitting attachment of the hollow cylindrical tube 12 to the driving stake means 18.

Figure 5:
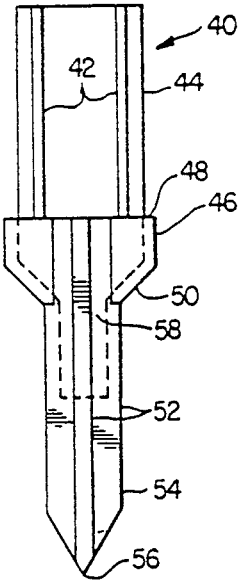
FIG. 5 is a front elevational view of a lower portion of another embodiment of this resilient post in accordance with the invention showing a flattened post with two reinforcing rods, the resilient post being connected with a driving stake means.

A second embodiment of the invention is shown in FIG. 5 which is a front elevational view of a lower portion of a solid resilient reinforced post 40. The resilient reinforced post 40 is in general a flat configuration having one or more reinforcing rods encapsulated within the post wherein the solid post member 44 can be affixed to a driving stake means 46 either by molding means during manufacture or by other means after the driving stake means 46 and the solid post member 44 have been manufactured separately. In any event, the resilient reinforced post 40 presents a one-piece post comprised of the solid post member 44, driving stake means 46 and with the driving stake means 46 having a driving head portion 48 which is exterior of the solid post member 44 which provides for direct driving of the stake portion. The driving stake means 46 has a neck portion 50 and various stabilizing rib means 52 for driving the penetrating tip means 54 into the ground. The stabilizing rib means provides for substantially vertical installation with ease during manual or mechanical driving. The configuration of the driving stake means 46 allowing for penetration into firm ground of the driving point 56, penetrating tip means 54 and stabilizing rib means 52 so that the driving stake means 46 is substantially inserted into the ground leaving a firm anchor which will withstand contact by moving vehicles with the resilient reinforced post 40. The stable anchoring of the driving stake means 46 and the combination of the resilient reinforced post through the actions of the material of construction and reinforcing rods 42 as anchored in the driving stake means 46 provides for self-erecting forces to be exerted by the construction of the resilient reinforced post 40. The reinforced post being inserted into and connected with the driving stake means 46 through a connection zone 58.

The embodiments of the invention as illustrated in FIGS. 1–4 provide a resilient post 10 wherein the hollow cylindrical tube 12 could be constructed of for example, a wall thickness of about 0.09" wherein the wall material is comprised of high density polyethylene, polypropylene, polyester and the like. The wall thickness can vary depending on the degree of resilience and the material of construction. On the other hand, the driving stake means 18 would be constructed of a more rigid material and be of a solid configuration other than for the grooves 26. The stake head means can be injected molded and joined with the resilient post hollow cylindrical tube 12 through thermal shrink fitting of the superimposed hollow cylindrical tube 12 over the stake head 25 inclusive of grooves 26 and stake head rib portions 27. The stake head 25 also has mounted therein and supports a flexible reinforcing rod 32 which can be comprised of a fiberglass rod having a dimension of $\frac{1}{8}'' \times 1'' \times 32''$. The flexible reinforcing rod can extend throughout substantially the entire length of the hollow cylindrical tube 12 but in general will be extended up to about 28–36" of the interior length of the cylindrical tube which will extend approximately 48 inches above the ground. The length of the driving stake means 18 can be varied depending on the type of soil and ground conditions normally encountered along roadways. For example, in sandy and loose soil conditions a longer driving stake means with a larger cross-sectional dimension such as illustrated in FIG. 4 might be called for as opposed to a tighter or clay-like soil in order to properly provide a base upon which the reinforcing rod and resilient post 10 or resilient post 40 are mounted in order to avoid being pulled from the ground upon impact of the post by a moving vehicle.

Figure 6:
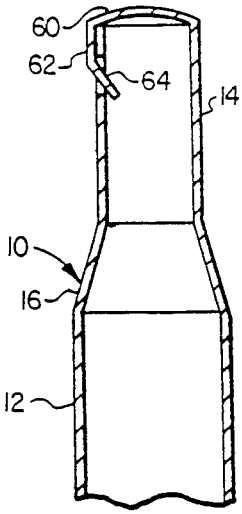
FIG. 6 is a partial sectional view showing one embodiment of a capping means which is a fold-over cap closure shown in place closing the top of the resilient hollow tube post.

In the embodiment of the invention as illustrated in FIG. 1, the hollow cylindrical tube 12 and upper end hollow portion 36 can be covered by a separate capping means (not shown) or by an integral fold-over cap means 60 as illustrated in the partial sectional view of FIG. 6. The separate capping means can be fastened to the upper end hollow portion 36 by inserting fasteners through openings in the separate capping means which match openings in the upper end portion surface 14. A capping means in the form of the fold-over cap closure is shown in a closed and locked position. The fold-over cap means 60 is comprised of an extension of the material of construction which forms the resilient post 10 with the flap being overlaid on the upper end hollow portion opening and with the loose flap end being inserted into a receiver means 64 for locking the flap 62 in place.

The resilient sign and guidepost according to the invention may be made by presently known plastic molding apparatus and processes involving the use of polymeric materials such as polyurethane, high density polyethylene, polypropylene, polyester and the like. These plastic materials may be relatively quickly formed in inexpensive mold apparatus and procedures. The use of these various polymeric materials are particularly advantageous in that the construction of the resilient post may be of different materials than the stake means and reinforcing rods and the like. For example, the post may be made from a polyester or polyether base thermal setting urethane with the stake portion being molded from high density polyethylene or polypropylene materials having substantial rigidity. In general, the resilient post will be constructed of polymeric materials or blends of polymeric materials having certain elastomeric characteristics and yet substantial mechanical properties including abrasion and mar resistance, low density, sufficient rigidity, chemical and weather resistance, structural integrity over a wide temperature range, impact resistance, resilience and memory and toughness with a high degree of elasticity.

The desired physical characteristics of the resilient sign and guidepost made in accordance with the present invention may be varied as necessary or desirable by dimensional changes and/or the use of the materials or a combination of materials. For example, if additional stiffness is desired, suitable amounts of fiberglass material may be added to the materials of construction or the cross-sectional diameter or thickness of the post portions may be increased with the use of techniques such as foaming the like to provide voids in order to maintain light weight.

A feature of the invention provides for minimizing the material and wall thickness of the hollow tube post or the general thickness of the non-hollow post in accordance with the invention while providing for self-erecting of the post having substantial length or height. The post of the invention also provides for ease and quick replacement in the event the post is damaged so that it will no longer be suitable for use. As a result, the time and labor required for installing and replacing the post by state highway departments are substantially reduced, thereby enabling more effective and efficient use of governmental funds and reducing the exposure of highway personnel to traffic.

The resilient sign and guidepost according to the invention is designed to meet the various federal and state specifications, for example, in one embodiment, to meet the Texas Test Specification For Flexible Delineation Posts as follows:

PART I

Low Temperature Impact Resistance

This part of the test determines the low temperature impact resistance of flexible delineator posts.

Equipment

1. A steel ball weighing approximately 200 pounds, with facilities for raising and releasing it from a height of 20 feet.
2. An environmental chamber or freezer capable of maintaining 0° to 10° F.
3. Polyurethane rubber base joint sealing compound.
4. A 6-inch diameter×12-inch high mold made of material that will not distort during impact testing of the post.
5. Supply of clean well-graded sand.

Procedure

1. Cut off the top end of the post selected for test so that a 48-inch length remains.
2. To prepare a mounting base, embed the post in sand to a depth of 12 inches in a 6-inch diameter mold. Seal the post in the sand with the joint seal to a depth of one inch. Allow the joint seal to cure for a minimum of 48 hours at room temperature before testing.
3. Place the test specimen into a 0° to 10° F. environment for a minimum of four hours prior to the impact test.
4. Raise the steel ball to a height of 5 feet.
5. Secure the test specimen horizontally in the ball drop mount assembly so that impact on the post will occur 18 inches out from the top of base. The side of the post designed to face traffic will be positioned so that the ball will strike it at an impact angle of 25° to 30°. In warm weather an insulating sleeve shall be used to preserve the temperature of the specimen while mounting prior to the first impact.
6. Place the impact attenuator at the base of the ball drop facility.
7. Raise the ball to a height of 20 feet above the post.
8. Release the steel ball. The first impact shall occur within 3 minutes of specimen removal from the freezer.
9. The post shall be carefully bent downward to allow the ball to again be raised to a height of 5 feet. Repeat Steps 4 through 8 until the specimen has been subjected to 5 impacts.
10. Rotate the test specimen until the plane of the post face is parallel to the ground and perpendicular to the path of the ball. Repeat Steps 4, 6, 7 and 8 and subject the post to an additional 5 impacts in this position. All 10 impacts must occur in a 50-minute period.

Criteria for Acceptance

A tested post will show no signs of cracking or splintering after 10 impacts.

PART II

Rigidity Determination

This part of the test will measure a flexible post's rigidity under static load by measuring deflection before and after the low temperature impact resistance test. The post will be prepared as stated in Procedures 1 and 2 of part I of this Test Method.

1. Suspend a 2-pound weight from the free end of the post. Measure the maximum deflection of the post from the horizontal position. Remove the weight.

2. Remove the specimen from the ball drop mount and stand it on a level surface. Measure the deflection of the post from the vertical position after one hour.

Criteria for Acceptance

A tested post, resting in the horizontal position, shall not deflect more than eight inches from its original horizontal position when a two-pound weight is suspended from the free end of the post while the other end is clamped into a support to provide a thirty-six inch cantilever.

A tested post when placed in a vertical position will not deflect more than three inches from its original vertical position.

PART III

Temperature Resistance

This part of the test measures the flexible delineator post's resistance to cracking or permanent deformation when bent 90° at extreme temperatures.

1. A post shall be placed in a conditioning chamber a minimum of two hours at each temperature specified. (If no temperatures are specified, temperatures of 140° F.±5° F. and 0° F.±5° F. shall be used.)

2. Test shall start within two minutes after removal of post from conditioning chamber and shall be completed in a maximum of seven minutes.

3. Hold the post securely with any suitable device and bend a 36" segment of the post to a 90° angle and release. Repeat the procedure for a total of four bends.

Criteria for Acceptance

After each bend a post will straighten itself out and show no adverse effect after 60 seconds. Cracking or permanent deformation shall be cause for rejection.

While the forms of resilient sign and guideposts which are self-erecting herein described constitute preferred embodiments of the invention, it is to be understood that the invention is not limited to these precise forms of resilient posts and that changes may be made therein without departing from the scope and spirit of the invention as defined in the appended claims.

The invention having thus been described, the following is claimed:

1. A resilient post suitable for use along roadways for marking or supporting roadway signs, comprising:

an elongated flexible hollow tube of resilient plastic material having an annular cross-section configuration;

the hollow tube having a lower end portion terminating in a driving stake means and an upper end portion having at least one partially flattened surface for mounting markers and sign apparatus;

the elongated flexible hollow tube having at least one reinforcing rod mounted interior of the hollow tube and in axial alignment extending from the driving stake means in which the enforcing rod is mounted through a substantial portion of the length of the elongated flexible hollow tube;

the hollow tube having sufficient diameter to allow access to the driving stake means driving head interior of the tube for driving the combination into the ground by direct driving force contact with the driving head of the driving stake means which is interior of the tube walls and exterior of the reinforcing rod.

2. The resilient post according to claim 1 wherein the elongated flexible hollow tube is joined with the driving stake means through a shrink fit of the tube onto the driving stake means through groove and stake head rib portions.

3. A resilient post according to claim 1 wherein the reinforcing rod is extended through the entire length of the elongated flexible hollow tube.

4. The resilient post according to claim 1 wherein the reinforcing rod extends up through at least about half the length of the elongated flexible hollow tube.

5. The resilient post according to claim 1 wherein the driving stake means is comprised of a drive head and a tapered lower portion inclusive of stabilizing driving ribs.

6. The resilient post according to claim 1 wherein the upper end portion having at least one partially flattened surface is of reduced dimension in comparison to the dimensions of the elongated flexible hollow tube.

7. A resilient post suitable for use for marking or supporting signs along roadways comprising in combination a linearly extending flexible resilient hollow tube of plastic material, said tube having a lower end portion terminating in a driving stake means adapted to project downwardly into the ground upon being driven by a force exerted directly onto the driving stake means and an upper end portion projecting substantially above the ground with means on said upper portion for mounting information signs or marking materials, the resilient post being capable of self-erecting having been hit and passing under a motor vehicle, the elongated hollow tube member being constructed of resilient flexible material and being provided further resiliency supported by at least one reinforcing rod mounted in the driving stake means and extending substantially through the hollow tube portion yet the combination allowing for driving stake means driving head accessability through the hollow tube, the driving stake means driving head being defined by the interior circumference of the hollow tube and the exterior dimensions of the reinforcing rod, the combination cooperating to provide a resilient post having a suitable number of selferection responses to motor vehicle impact on the post.

* * * * *

UNITED STATES PATENT AND TRADEMARK OFFICE

CERTIFICATE OF CORRECTION

PATENT NO. : 5,066,163

DATED : November 19, 1991

INVENTOR(S) : Kerry Whitaker

It is certified that error appears in the above-identified patent and that said Letters Patent is hereby corrected as shown below:

Column 8, line 61, --delineator-- should be inserted after the word "flexible".

Signed and Sealed this

Twenty-third Day of March, 1993

*Attest:*

STEPHEN G. KUNIN

*Attesting Officer*

*Acting Commissioner of Patents and Trademarks*